US007866779B2

(12) United States Patent
Martinez et al.

(10) Patent No.: US 7,866,779 B2
(45) Date of Patent: Jan. 11, 2011

(54) DEFECTIVE NOZZLE REPLACEMENT IN A PRINTER

(75) Inventors: Angel Martinez, Barcelona (ES); Alex Andrea, Barcelona (ES); David Gaston, Barcelona (ES); Joan Jorba, Barcelona (ES); Silvia Miramanda, Barcelona (ES); Sergio Puigardeu, Barcelona (ES); Marti Rius, Barcelona (ES); Jordi Sender, Barcelona (ES); Ramon Vega, Sabadell (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 297 days.

(21) Appl. No.: 12/243,595

(22) Filed: Oct. 1, 2008

(65) Prior Publication Data

US 2009/0128594 A1 May 21, 2009

Related U.S. Application Data

(60) Provisional application No. 60/988,601, filed on Nov. 16, 2007.

(51) Int. Cl.
*B41J 29/38* (2006.01)

(52) U.S. Cl. ..... 347/13

(58) Field of Classification Search ..... 347/12, 347/13, 19

See application file for complete search history.

(56) References Cited

U.S. PATENT DOCUMENTS 5,581,284 A 12/1996 Hermanson
5,796,416 A 8/1998 Silverbrook
6,027,203 A 2/2000 Campbell
6,089,693 A * 7/2000 Drake et al. ..... 347/19
6,273,542 B1 8/2001 Couwenhoven et al.
6,481,820 B1 * 11/2002 Tamura et al. ..... 347/19
6,905,191 B2 6/2005 Krouss
6,942,308 B2 * 9/2005 Molinet et al. ..... 347/4
7,207,647 B2 4/2007 Silverbrook
2005/0179724 A1 8/2005 Salt et al.
2006/0050318 A1 3/2006 Miyagi et al.
2006/0071951 A1 4/2006 Walmsley et al.
2006/0125859 A1 6/2006 Walmsley et al.
2006/0132521 A1 6/2006 Walmsley et al.
2006/0139386 A1 6/2006 Silverbrook et al.
2006/0139388 A1 6/2006 Silverbrook et al.
2006/0139394 A1 * 6/2006 Wada ..... 347/19
2006/0164453 A1 7/2006 Silverbrook et al.
2006/0256157 A1 11/2006 Kim et al.
2007/0070108 A1 * 3/2007 Mantell et al. ..... 347/19
2007/0153035 A1 * 7/2007 Jung et al. ..... 347/9

* cited by examiner

*Primary Examiner*—Julian D Huffman

(57) ABSTRACT

Printing is performed at a full resolution using a first set of nozzles and a second set of nozzles arranged on a printhead. Printing is performed at less than the full resolution using the first set of nozzles less any nozzles in the first set of nozzles that have been determined to be defective. The second set of nozzles is not used for printing at less than the full resolution except for a subset of nozzles in the second set of nozzles that are used to replace nozzles from the first set of nozzles that have been determined to be defective.

18 Claims, 5 Drawing Sheets

DEFECTIVE NOZZLE REPLACEMENT IN A PRINTER

CROSS REFERENCE TO RELATED APPLICATIONS

This Application cairns the benefit of provisional patent application Ser. No. 60/988,601, filed Nov. 16, 2007, titled "DEFECTIVE NOZZLE REPLACEMENT IN A PRINTER" which application is incorporated by reference herein as if reproduced in full below.

BACKGROUND

Inkjet printing mechanisms often use moveable cartridges, also called pens, that use one or more printheads formed with very small nozzles through which drops of liquid ink (e.g., dissolved colorants or pigments dispersed in a solvent) are fired. To print an image, the carriage traverses over the surface of the print medium, and the ink ejection elements associated with the nozzles are controlled to eject drops of ink at appropriate times pursuant to command of a microcomputer or other controller. The pattern of pixels on the print media resulting from the firing of ink drops results in the printed image.

In multiple pass print modes, printhead nozzles can pass over the same media position several times. When a nozzle is defective, that is, for some reasons fails to operate properly, a multiple pass print mode allows the opportunity for other nozzles to cover for the defective nozzle and print on the media without noticeable degradation of quality.

When using single pass modes or when printheads are fixed it can be more difficult to compensate for a nozzle that fails to operate properly. Failure to compensate for a defective nozzle can lead to degraded print output that can show banding or other undesired printing effects.

DESCRIPTION OF THE EMBODIMENT

Figure 1:
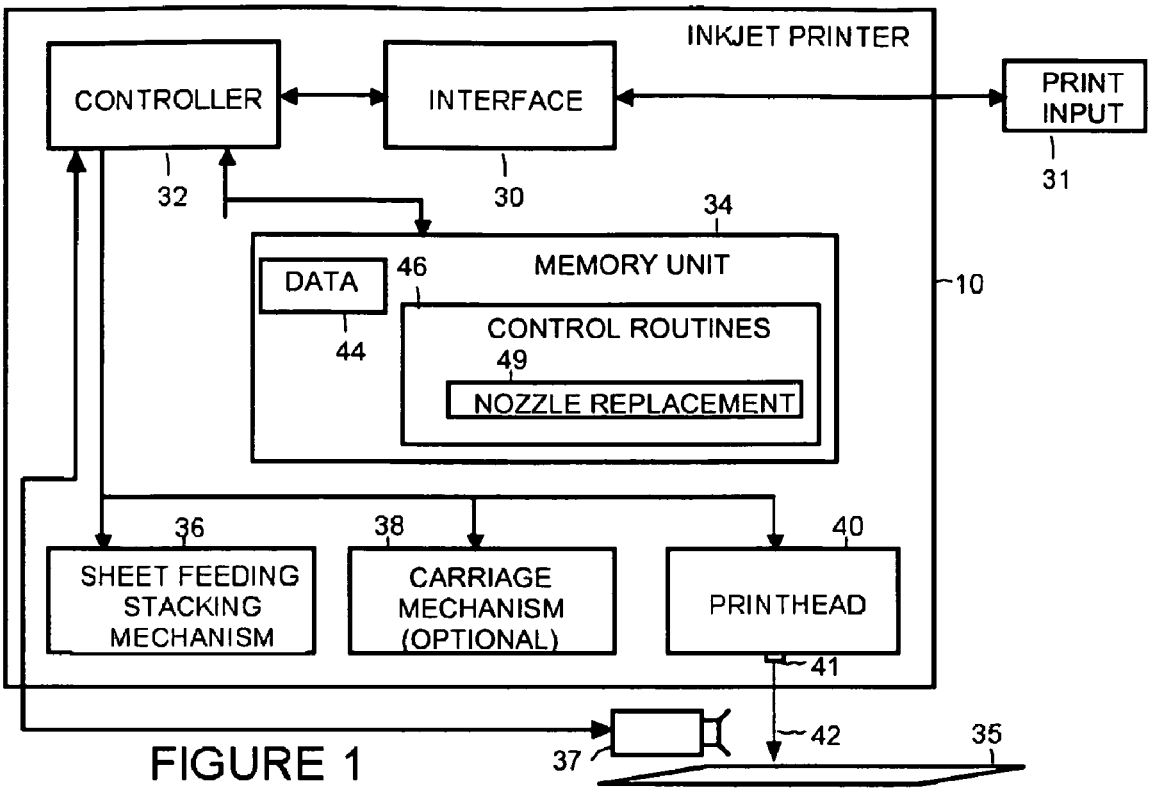
FIG. 1 is a simplified block diagram of an inkjet printer in accordance with an embodiment of the present invention.

FIG. 1 is a simplified block diagram of an inkjet printer 10. Inkjet printer 10 includes, for example, a controller 32 that, via an interface unit 30, receives print input 31 from a computer system or some other device, such as a scanner or fax machine. The interface unit 30 facilitates the transferring of data and command signals to controller 32 for printing purposes. Interface unit 30 also enables inkjet printer 10 to download print image information to be printed on a print medium 35.

Inkjet printer 10 includes a memory unit 34. For example, memory unit 34 is divided into a plurality of storage areas that facilitate printer operations. For example, the storage areas can include a data storage area 44 and control routines 46.

Data area 44 receives data files that define the individual pixel values that are to be printed to from a desired object or textual image on medium 35.

Control routines 46 hold printer driver routines and the algorithms that facilitate the mechanical control implementation of the various mechanical mechanisms of inkjet printer 10. For example, the algorithms within control routines 46 control a sheet feeding stacking mechanism for moving a medium through the printer from a supply or feed tray to an output tray. When printer 10 includes a printhead carriage unit, control routines 46 include the routines that control a carriage mechanism that causes the printhead carriage unit to be moved across a print medium on a guide rod. Control routines 46 also contain a replacement nozzle routine 49.

In operation, inkjet printer 10 responds to commands by printing full color or black print images on print medium 35. In addition to interacting with memory unit 34, controller 32 controls a sheet feeding stacking mechanism 36 and, when present, a carriage mechanism 38. Controller 32 also forwards printhead firing data to one or more printheads, represented in FIG. 1 by a printhead 40. The input data received at interface 30 includes, for example, information describing printed characters and/or images for printing. For example, input data may be in a printer format language such as Postscript, PCL 3, PCL 5, HPGL, HPGL 2 or some related version of these. Alternatively, the input data may be formatted as raster data or formatted in some other printer language. The printhead firing data sent to printhead 40 is used to control the ejection elements associated with the nozzles of an ink jet printer, such as for thermal ink jet printer, piezo ink jet printers or other types of ink jet printers.

A defective nozzle detector system 37 detects print quality of printed pixels. For example, defective nozzle detector system 37 optically monitors an ink stream ejected from each nozzle in a printhead to confirm proper operation of the nozzle. This is represented in FIG. 1 by defective nozzle detector system 37 monitoring an ink stream 42 emitted from a nozzle 41 of printhead 40. Alternatively, defective nozzle detector system 37 can be any type of system that can determine print quality of pixels deposited by a printer.

Figure 2:
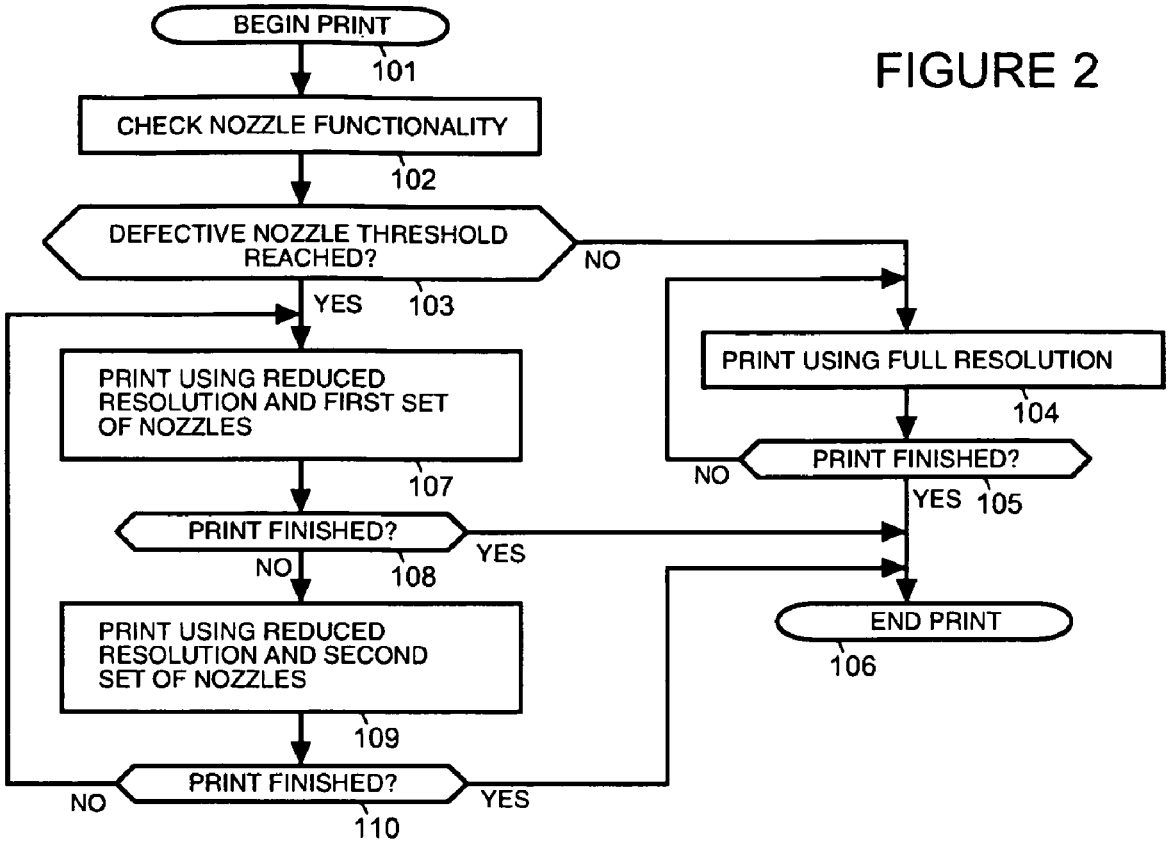
FIG. 2 is a simplified flowchart that illustrates compensation for defective nozzles in accordance with an embodiment of the present invention.

FIG. 2 is a simplified flowchart that illustrates operation of replacement nozzle routine 49 as it compensates for defective nozzles. A defective nozzle is any nozzle that is not operating satisfactory. In a block 101, a print job is begun. In a block 102, nozzle functionality is checked. This is done, for example, using defective nozzle detector system 37 shown in FIG. 1.

While in the illustrated operation described in FIG. 2, nozzle operation is checked at the beginning of a print job, the frequency of a check for nozzle functionality can vary depending upon a chosen implementation. For example, nozzle functionality can be checked several times during a print job, or only after a specified number of print jobs have been completed. Alternatively, or in addition, nozzle functionality can be checked upon printer start-up.

In a block 103, a check is made whether a defective nozzle threshold is reached. The defective nozzle threshold can be one defective nozzle, or the defective nozzle threshold can be greater than one defective nozzle. Depending on the printer, degradation of print resulting from one or more defective nozzles may not be noticeable to a user until a certain number of nozzles are defective. Therefore, depending upon the quality of print produced by a printer and the desired output quality, the defective nozzle threshold can vary. A defective nozzle threshold can be calculated based on the number of defective nozzles on each printhead or can be calculated based on the number of defective nozzles in just a subset of nozzles on each printhead. Alternatively, the defective nozzle threshold can be based on all nozzles used for printing, regardless of the number of printheads used.

Figure 3:
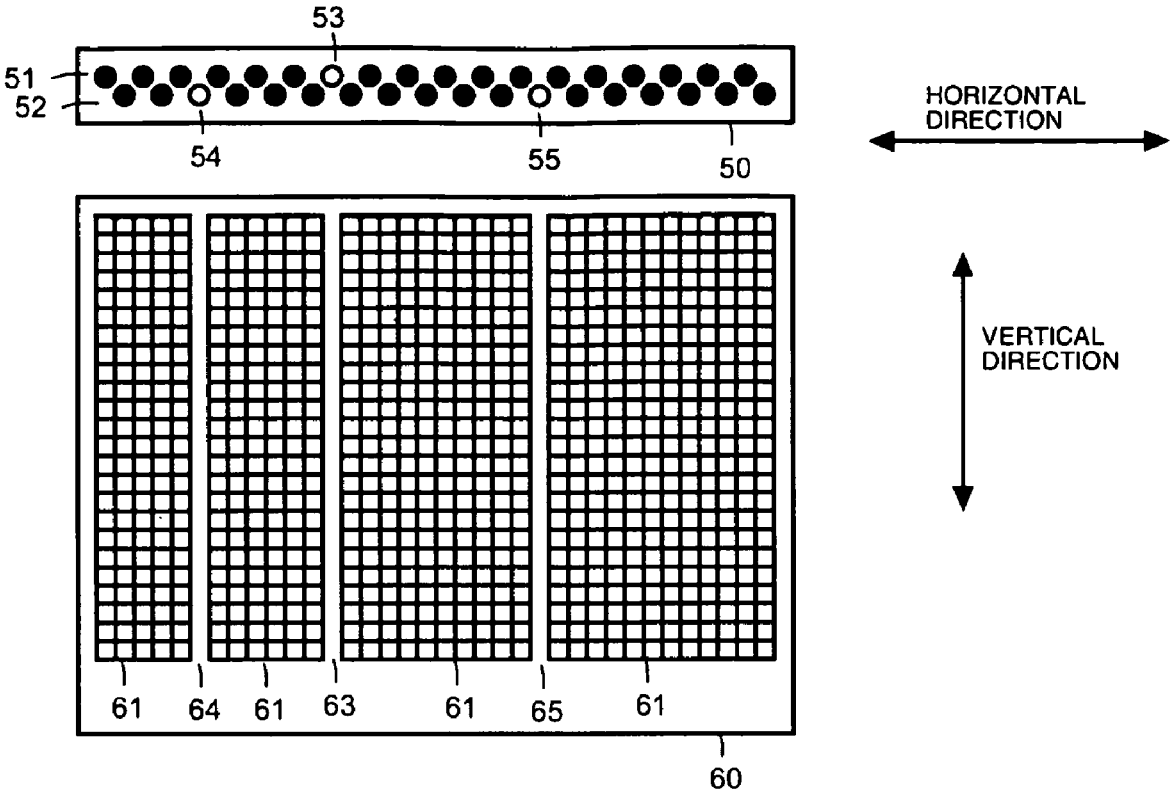
FIG. 3 illustrates banding than can appear in print output as a result of defective nozzles.

FIG. 3 illustrates banding than can appear in print output as a result of defective nozzles. A printhead section 50 includes a row of nozzles 51 and a row of nozzles 52. Row of nozzles 51 and row of nozzles 52 are offset from one another.

In the example shown in FIG. 3, printhead section 50 is part of a page-wide printhead array where printhead location is fixed and media is moved in a single dimension, (referred to as vertical direction) under the printhead. Thus, relative to the printhead, location of the media is fixed in the horizontal direction, and moves in the vertical direction. While for clarity of explanation, the invention is illustrated using a fixed printhead, as will be understood by persons of ordinary skill in the art, the invention is also applicable to printers with printheads mounted on moveable carriages.

Because the relative spacing between nozzles in row of nozzles 51 and the relative spacing between nozzles in row of nozzles 52 is the same, when using just row of nozzles 51 or just row of nozzles 52 for printing, a first horizontal print resolution can be achieved. Because horizontal placement of nozzles in row of nozzles 52 is staggered with respect to horizontal placement of nozzles in row of nozzles 51, using both row of nozzles 51 and row of nozzles 52 when printing allows printing with double the first horizontal print resolution. Thus, for example, if using just row of nozzles 51 or just row of nozzles 52 for printing allows for a print resolution of 600 dots per inch (dpi) in the horizontal direction, using both row of nozzles 51 and row of nozzles 52 for printing allows for a print resolution of 1200 dpi in the horizontal direction.

Print output from printhead section 50 is represented by a printed pattern 61 on a section of media 60. Each little box in printed pattern 61 illustrates a potential location of ink being deposited by a nozzle from row of nozzles 51 or row of nozzles 52. As section of media 60 moves in the vertical direction with respect to printhead section 50, rows of ink dots can be deposited.

In the hypothetical case illustrated by FIG. 3, a nozzle 53 in row of nozzles 51 is defective. Likewise, a nozzle 54 and a nozzle 55 in row of nozzles 52 are also defective. A nozzle defect can result from, for example, a nozzle being clogged, misaligned or in some way damaged so that output from the nozzle is detected to be inferior to a required standard of performance.

In this case, no ink is deposited by nozzle 53, nozzle 54 and nozzle 55. The result is that printed pattern 61 is broken in the vertical direction by a band 63, a band 64 and a band 65.

If, in block 103 shown in FIG. 2, the defective nozzle threshold has not been reached, in a block 104, printing is performed using full resolution in the horizontal direction. For example, this would result in printing being performed using all working nozzles in row of nozzles 51 and row of nozzles 52. In a block 105, a check is made to determine whether printing is finished. If so, in a block 106, the print job is completed.

If, in block 103, the defective nozzle threshold has been reached, in a block 107, printing is performed using reduced resolution in the horizontal direction and only a first of two sets of nozzles, except that particular nozzles in the second set of nozzles are used to compensate for any defective nozzles in the first set of nozzles. This is illustrated in FIG. 4.

Figure 4:
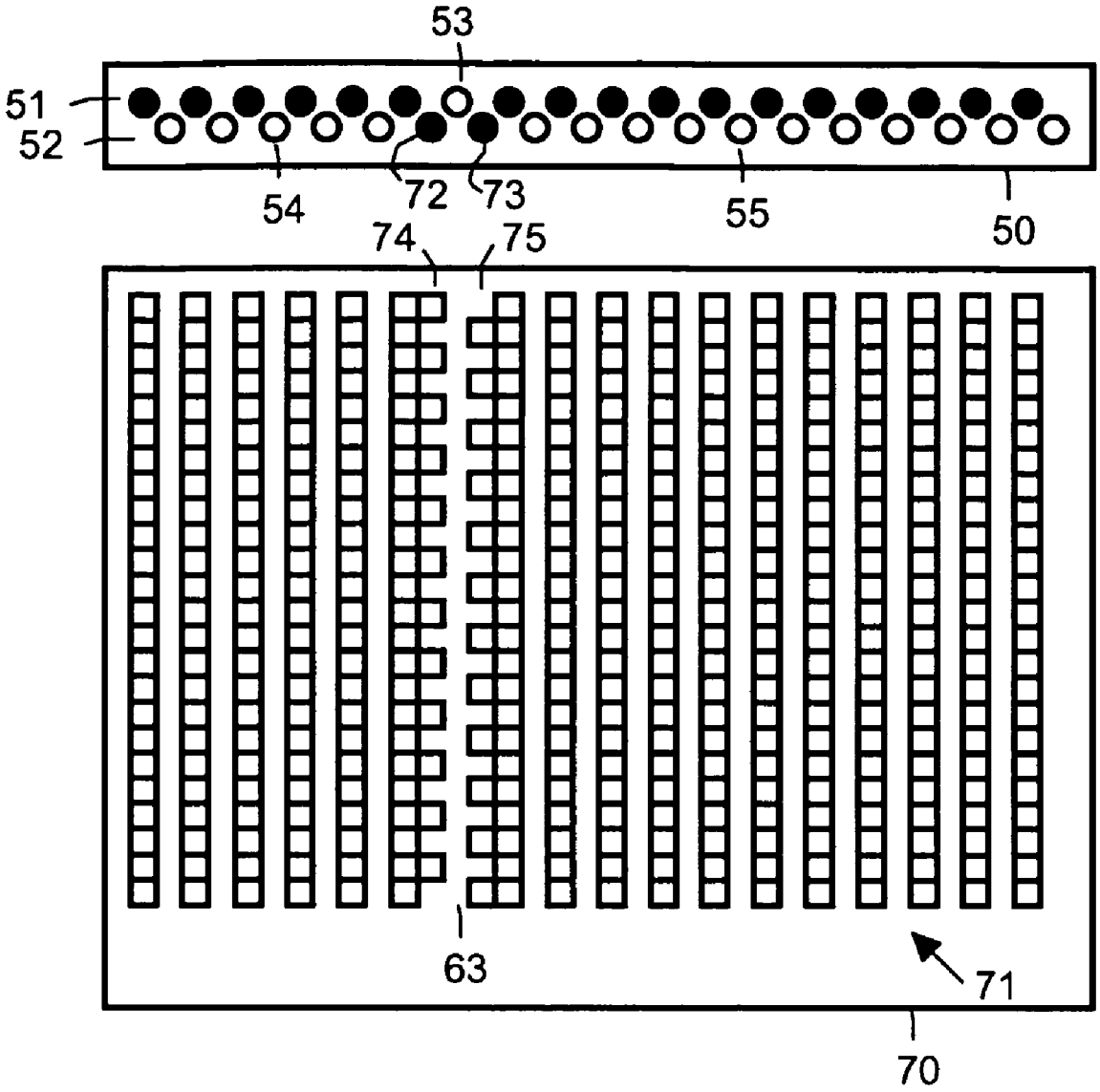
FIG. 4 and FIG. 5 illustrate output that has been compensated for defective nozzles in accordance with an embodiment of the present invention.

FIG. 4 illustrates output that has been compensated for defective nozzles. When printing, row of nozzles 51 is used. This results in a printed pattern 71 on a section of media 70 being at one half of full resolution. In addition, in order to compensate for defective nozzle 53 in row of nozzles 51, a nozzle 72 and a nozzle 73 from row of nozzles 52 are also used in printing. Nozzle 72 and nozzle 73 are the two nozzles from row of nozzles 52 that are closest in horizontal position to the horizontal position of defective nozzle 53.

In order to maintain a consistent pixel density, nozzle 72 and nozzle 73 are used in alternating rows. This is illustrated in FIG. 4 where within printed pattern 71, potential locations of ink deposited by nozzle 72, as represented by boxes in a column 74, are in alternate rows to potential locations of ink deposited by nozzle 73, as represented by boxes in a column 75. As will be understood by persons of ordinary skill in the art, other patterns, rather than alternating rows can be used. For example, a one-two-one pattern, a one-three-two pattern, or any other pattern of using nozzle 72 and nozzle 73 to print in various rows can be used. For example, in another pattern, nozzle 72 and nozzle 73 can both be used to print in one row and then neither nozzle 72 or nozzle 73 can be used in the next row. Alternatively, nozzles in row 52 other than, or in addition to, nozzle 72 and nozzle 73 can be used to compensate for defective nozzle 53.

In order to prevent nozzles from row of nozzles 52 from drying out and developing soft plugs as a result of not being used, it can be beneficial to switch from using row of nozzles 51 for printing to using row of nozzles 52. This can be done for separate print jobs, or can occur within the same print jobs.

For example, FIG. 2 illustrates this by a block 108 and a block 109 where, after a predetermined time, when printing has not finished, a second set of nozzles is used to proceed with the print job. In block 109 printing is performed using reduced resolution in the horizontal direction and the second set of nozzles, except that particular nozzles in the first set of nozzles are used to compensate for any defective nozzles in the second set of nozzles.

Figure 5:
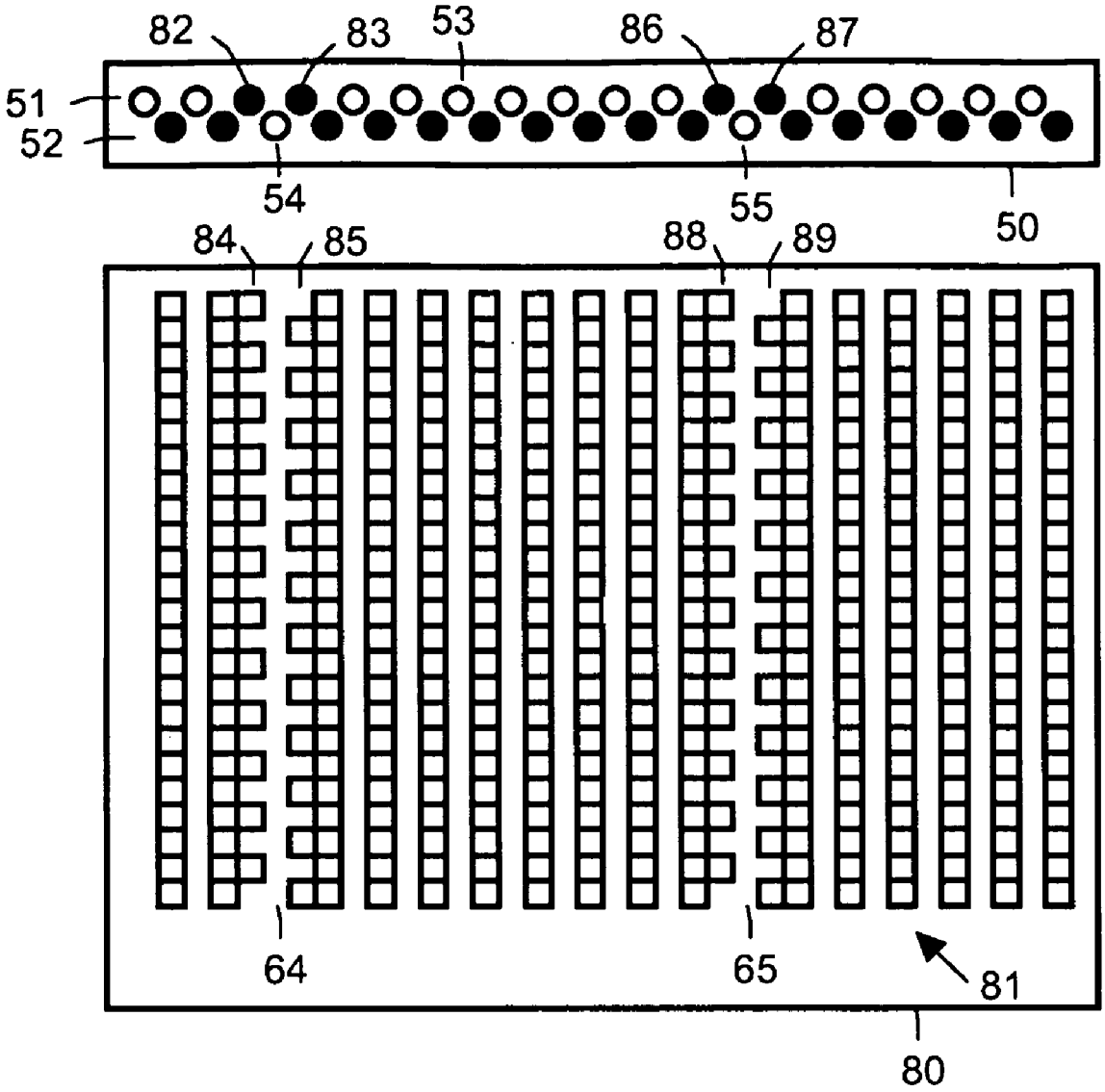

FIG. 5 illustrates output resulting when printing is switched from row of nozzles 51 to row of nozzles 52. Printing using, row of nozzles 52 results in a printed pattern 81 on a section of media 80 being at one half of full resolution. In order to compensate for defective nozzle 54 in row of nozzles 52, a nozzle 82 and a nozzle 83 from row of nozzles 51 are also used in printing. Nozzle 82 and nozzle 83 are the two nozzles from row of nozzles 51 that are closest in horizontal position to the horizontal position of defective nozzle 54.

In order to maintain a consistent pixel density, nozzle 82 and nozzle 83 are used in alternating rows. This is illustrated in FIG. 5 where within printed pattern 81, potential locations of ink deposited by nozzle 82, as represented by boxes in a column 84, are in alternate rows to potential locations of ink deposited by nozzle 83, as represented by boxes in a column 85. As will be understood by persons of ordinary skill in the art, other patterns, rather than alternating rows can be used.

In order to compensate for defective nozzle 55 in row of nozzles 52, a nozzle 86 and a nozzle 87 from row of nozzles 51 are also used in printing. Nozzle 86 and nozzle 87 are the two nozzles from row of nozzles 51 that are closest in horizontal position to the horizontal position of defective nozzle 55.

In order to maintain a consistent pixel density, nozzle 86 and nozzle 87 are used in alternating rows. This is illustrated in FIG. 5 where within printed pattern 81, potential locations of ink deposited by nozzle 86, as represented by boxes in a column 88, are in alternate rows to potential locations of ink deposited by nozzle 87, as represented by boxes in a column 89. As will be understood by persons of ordinary skill in the art, other patterns, rather than alternating rows can be used.

In order to prevent nozzles from row of nozzles 51 from drying out and developing soft plugs as a result of not being used, in can be beneficial to switch back to use row of nozzles 51 for printing. For example, FIG. 2 illustrates this by a block 110 where, after a predetermined time, when printing has not finished, the first set of nozzles is again used to proceed with the print job.

For example, as shown in FIG. 3, FIG. 4 and FIG. 5, printhead section 50 includes only nozzles of a same color. When using sections of different color nozzles horizontal resolution can be reduced to one half for all colors whenever the defective nozzle threshold is reached for any color. Alternatively, horizontal resolution can be reduced to one half only for those colors where the defective nozzle threshold has been reached. Alternatively, horizontal resolution can be reduced to one half for any subset of colors.

For example, as illustrated in FIG. 4 and FIG. 5, resolution is reduced by one half to allow for nozzle replacement. As will be understood by persons of ordinary skill in the art, resolution can also be reduced an amount other than one half. For example, where horizontal resolution is supplied by three staggered rows of nozzles, resolution can be reduced by one third by not using nozzles within one of the three rows except for the purpose of nozzle replacement. Alternatively, where horizontal resolution is supplied by three staggered rows of nozzles, resolution can be reduced by two thirds by not using nozzles within two of the three rows except for the purpose of nozzle replacement. And so on.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A printing system comprising a controller and a memory unit, wherein the controller is configured to execute a routine stored in the memory unit to control a printhead having a first set of nozzles and a second set of nozzles, wherein controlling the printhead comprises:

causing the printhead to print with the first set of nozzles and not with the second set of nozzles, when printing at a first horizontal resolution, and causing the printhead to print with both the first set of nozzles and the second set of nozzles when printing at a second horizontal resolution, the second horizontal resolution being greater than the first horizontal resolution; and replacing a defective nozzle in the first set of nozzles by, when printing is performed with just the first nozzles at the first resolution, not using the second set of nozzles for printing except for a plurality of nozzles in the second set of nozzles that are located in a horizontal position close to a horizontal position of the defective nozzle, the plurality of nozzles in the second set of nozzles being used to replace output from the defective nozzle.

2. A printing system as in claim 1 wherein the first horizontal resolution is one half the second horizontal resolution.

3. A printing system as in claim 1 wherein when printing, the printhead is fixed in a horizontal position with respect to movement of the media in a vertical direction through a printer.

4. A printing system as in claim 1 wherein the first horizontal resolution is 600 dots per inch and the second horizontal resolution is 1200 dots per inch.

5. A printing system as in claim 1 wherein a plurality of nozzles in the second set of nozzles that are located in a horizontal position close to a horizontal position of the defective nozzle include exactly two nozzles in the second set of nozzles that are located in a horizontal position closest to the horizontal position of the defective nozzle.

6. A printing system as in claim 1 wherein in order to replace a second defective nozzle in the first set of nozzles, a second plurality of nozzles in the second set of nozzles that are located in a horizontal position close to a horizontal position of the second defective nozzle are also used for printing, the second plurality of nozzles in the second set of nozzles being used to replace output from the second defective nozzle.

7. A printing system as in claim 1 wherein a plurality of nozzles in the second set of nozzles that are located in a horizontal position close to a horizontal position of the defective nozzle include a first nozzle and a second nozzle in the second set of nozzles that are located in a horizontal position closest to the horizontal position of the defective nozzle, the first nozzle and the second nozzle being used to print pixel data in alternate rows, the first nozzle and the second nozzle not being used to print pixel data in a same row.

8. A printing system as in claim 1 wherein controlling the print head comprises:

causing the printhead to print with the second set of nozzles and not the first set of nozzles when printing at a third horizontal resolution; and replacing a second defective nozzle in the second set of nozzles by, when printing is performed with just the second nozzles at the third resolution, not using the first set of nozzles for printing except for a plurality of nozzles in the first set of nozzles that are located in a horizontal position close to a horizontal position of the second defective nozzle, the plurality of nozzles in the first set of nozzles being used to replace output from the second defective nozzle.

9. A printing system as in claim 8 wherein the third resolution is equal to the first resolution.

10. A printing system as in claim 8 additionally comprising a defective nozzle detection system, wherein the defective nozzle detection system is configured to detect that a number of defective nozzles has reached a defective nozzle threshold, and wherein controlling the print head comprises causing the printhead to print for a predetermined duration at the first horizontal resolution using the first set of nozzles and only nozzles from the second set of nozzles that are used to replace any defective nozzles in the first set of nozzles, and after the predetermined duration, causing the printhead to print at the third horizontal resolution using the second set of nozzles and only nozzles from the first set of nozzles that are used to replace any defective nozzles in the second set of nozzles.

11. A method for printing comprising:

printing at a full resolution using a first set of nozzles and a second set of nozzles arranged on a print head; and, printing at less than the full resolution using the first set of nozzles less any nozzles in the first set of nozzles that have been determined to be defective, the second set of nozzles not being used for printing except for a subset of nozzles in the second set of nozzles that are used to replace nozzles from the first set of nozzles that have been determined to be defective.

12. A method as in claim 11 wherein when printing at less than the full resolution, printing is performed at a resolution that in a single dimension is one half the full resolution.

13. A method as in claim 11 additionally comprising:

printing at less than the full resolution using the second set of nozzles less any nozzles in the second set of nozzles that have been determined to be defective, the first set of nozzles not being used for printing except for a subset of nozzles in the first set of nozzles that are used to replace nozzles from the second set of nozzles that have been determined to be defective.

14. A method as in claim 11 additionally comprising:

determining whether the first set of nozzles and the second set of nozzles have a number of defective nozzles that reaches a defective nozzle threshold;

printing at the full resolution when the first set of nozzles and the second set of nozzles do not have a number of defective nozzles that reaches the defective nozzle threshold; and, printing at less than the full resolution when the first set of nozzles and the second set of nozzles do have a number of defective nozzles that reaches the defective nozzle threshold.

15. A printer comprising:

a printhead, the printhead including a first set of nozzles and a second set of nozzles; and, means for printing at a full resolution using the first set of nozzles and the second set of nozzles and for printing at less than the full resolution using the first set of nozzles less any nozzles in the first set of nozzles that have been determined to be defective so that the second set of nozzles are not used for printing except for a subset of nozzles in the second set of nozzles that are used to replace nozzles from the first set of nozzles that have been determined to be defective.

16. A printer as in claim 15 wherein when printing, the printhead is fixed in a horizontal position with respect to movement of media in vertical direction through the printer.

17. A printer as in claim 15 wherein the means for printing includes means for printing at less than the full resolution using the second set of nozzles less any nozzles in the second set of nozzles that have been determined to be defective so that the first set of nozzles are not used for printing except for a subset of nozzles in the first set of nozzles that are used to replace nozzles from the second set of nozzles that have been determined to be defective.

18. A printer as in claim 15 additionally comprising:

means for determining whether the first set of nozzles and the second set of nozzles have a number of defective nozzles that reaches a defective nozzle threshold so that the printer prints at the full resolution when the first set of nozzles and the second set of nozzles do not have a number of defective nozzles that reaches the defective nozzle threshold and the printer prints at less than the full resolution when the first set of nozzles and the second set of nozzles do have a number of defective nozzles that reaches the defective nozzle threshold.

* * * * *